US008303107B2

(12) United States Patent
Kasiske, Jr. et al.

(10) Patent No.: US 8,303,107 B2
(45) Date of Patent: Nov. 6, 2012

(54) PRINTING METHOD INCLUDING WEB MEDIA MOVING APPARATUS

(75) Inventors: W. Charles Kasiske, Jr., Penfield, NY (US); Michael J. Piatt, Dayton, OH (US); Harsha S. Bulathsinghalage, Miamisburg, OH (US); John L. Hryhorenko, Webster, NY (US); Randy E. Armbruster, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 13/040,772

(22) Filed: Mar. 4, 2011

(65) Prior Publication Data

US 2012/0224010 A1 Sep. 6, 2012

(51) Int. Cl.
*B41J 2/01* (2006.01)

(52) U.S. Cl. ..... 347/104; 347/16; 271/188

(58) Field of Classification Search ..... 347/101, 347/102, 104, 105, 16; 271/188
See application file for complete search history.

(56) References Cited

U.S. PATENT DOCUMENTS 2,980,015 A * 4/1961 Zentner et al. ..... 101/170
3,099,146 A * 7/1963 Yamawaki ..... 68/203
3,744,414 A * 7/1973 Krochert et al. ..... 101/148
5,393,151 A * 2/1995 Martin et al. ..... 400/642
5,419,644 A * 5/1995 Martin et al. ..... 400/642
5,820,122 A * 10/1998 Schneider ..... 271/188
6,003,988 A 12/1999 McCann et al.

FOREIGN PATENT DOCUMENTS

EP 0813971 A2 * 12/1997

OTHER PUBLICATIONS

Roisum, David R., "The Mechanics of Web Spreading: Part 1 & Part 2", Tappi Journal, vol. 76, Oct. 1993, pp. 63-85.

* cited by examiner

*Primary Examiner* — Julian Huffman
*Assistant Examiner* — Sharon A Polk
(74) *Attorney, Agent, or Firm* — William R. Zimmerli

(57) ABSTRACT

A method of printing includes providing a printhead and providing a roller positioned downstream from the printhead. The printhead is used to selectively moisten at least a portion of the web of print media as the web of print media is guided through the printing system. The print media is caused to contact and wrap around a portion of the roller as the print media moves past the roller. The roller, having an axis of rotation, includes a pattern of recesses and ridges positioned along the axis of rotation of the roller. A second section of the roller is located between a first section of the roller and a third section of the roller as viewed along the axis of rotation. The roller includes a profile as viewed along the axis of rotation in which the diameter of the ridges located in the first section of the roller and the diameter of ridges located in the third section of the roller are greater than the diameter of the ridges located in the second section of the roller.

4 Claims, 9 Drawing Sheets

PRINTING METHOD INCLUDING WEB MEDIA MOVING APPARATUS

CROSS REFERENCE TO RELATED APPLICATIONS

Reference is made to commonly-assigned, U.S. patent application Ser. No. 13/040,715, entitled "WEB MEDIA MOVING APPARATUS", Ser. No. 13/040,732, entitled "WEB MEDIA MOVING METHOD", and Ser. No. 13/040,754, entitled PRINTING SYSTEM INCLUDING WEB MEDIA MOVING APPARATUS", all filed concurrently herewith.

FIELD OF THE INVENTION

This invention relates generally to a printing system for printing on a web of print media, and in particular to an apparatus for moving the web of print media through the printing system.

BACKGROUND OF THE INVENTION

Some digital printing systems and processes, for example, inkjet printing systems and processes introduce significant moisture content during operation, particularly when the system is used to print multiple colors on a print media. Due to its moisture content, the print media expands and contracts in a non-isotropic manner often with significant hysteresis. The continual change of dimensional characteristics of the print media often adversely affects image quality. Although drying is used to remove moisture from the print media, drying too frequently, for example, after printing each color, also causes changes in the dimensional characteristics of the print media that often adversely affects image quality.

During an inkjet printing process, as the print media absorbs the water-based inks applied to it, the print media desires to expand. When the direction of expansion is in a direction that is perpendicular to the direction of media travel, it is often referred to as expansion in the cross-track direction. For example, when the print media wraps around a roller of an inkjet printing system, the outer, typically unprinted, edges of the print media remain attached to the roller although the remaining typically printed portions of the print media expand outwardly. The outward expansion, commonly referred to as buckling, of the print media in the cross-track direction between the firmly attached outer edges of the print media creates lengthwise ripples or wrinkles in the print media. Wrinkling of the print media during the printing process often leads to permanent creases forming in the print media which ultimately affects image quality.

As such, there is an ongoing need to provide digital printing systems and processes with the ability to effectively handle print media expansion associated with the absorption of water by the print media.

SUMMARY OF THE INVENTION

According to an aspect of the invention, a method of printing includes providing a printhead and providing a roller positioned downstream from the printhead. The printhead is used to selectively moisten at least a portion of the web of print media as the web of print media is guided through the printing system. The print media is caused to contact and wrap around a portion of the roller as the print media moves past the roller. The roller, having an axis of rotation, includes a pattern of recesses and ridges positioned along the axis of rotation of the roller. A second section of the roller is located between a first section of the roller and a third section of the roller as viewed along the axis of rotation. The roller includes a profile as viewed along the axis of rotation in which the diameter of the ridges located in the first section of the roller and the diameter of ridges located in the third section of the roller are greater than the diameter of the ridges located in the second section of the roller.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
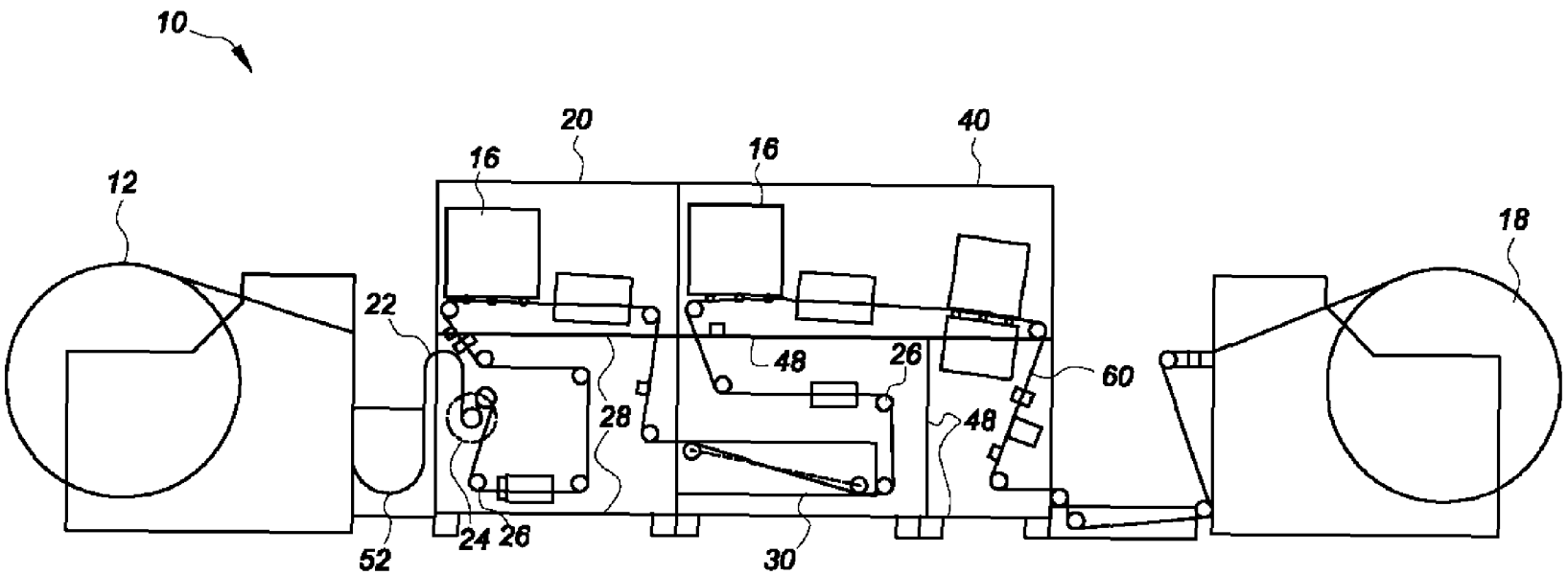
FIG. 1 is a schematic side view of a digital printing system according to an example embodiment of the present invention.

The present description will be directed in particular to elements forming part of, or cooperating more directly with, apparatus in accordance with the present invention. It is to be understood that elements not specifically shown or described take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

In the context of the present disclosure, the term "continuous web of print media" relates to a print media that is in the form of a continuous strip of media as it passes through the printing system from an entrance to an exit thereof. The continuous web of print media itself serves as the receiving print medium to which one or more printing ink or inks or other coating liquids are applied in non-contact fashion. This is distinguished from various types of "continuous webs" or "belts" that are actually transport system components rather than receiving print media and that are typically used to transport a cut sheet medium in an electrophotographic or other printing system. The terms "upstream" and "downstream" are terms of art referring to relative positions along the transport path of a moving web; points on the web move from upstream to downstream.

Generally described, an apparatus and method of moving a web of print media includes a roller that rotates about an axis of rotation as the print media makes contact with and wraps around a portion of the roller as the print media moves past the roller. The roller includes a pattern of recesses and ridges positioned along the axis of rotation that help compensate for cross track expansion of the print media caused by the absorption of water-based ink that is applied to the print media in the print zone. The recesses and ridges also help to reduce the likelihood of the print media wrinkling as the print media wraps around roller and moves through printing system.

The printing system and method including the web moving apparatus are particularly well suited for printing devices that provide non-contact application of ink, typically water based ink, or other colorant onto a continuously moving web of print media. The printhead of the printing system selectively moistens at least some portion of the media as it courses through the printing system, but without the need to make contact with the print media.

Example embodiments of the print media web moving apparatus are described below with reference to FIGS. 5-8. Example embodiments of printing systems including one or plurality of print media web moving apparatus are described below with reference to FIGS. 1-4. When included in one of the printing systems described with reference to FIG. 2 or 3, print media web moving apparatus is typically located in one or both of roller positions G or M. When included in the printing system described with reference to FIG. 4, print media web moving apparatus is typically located in roller position M.

The digital printing system can also include components for drying or curing of the printing fluid on the media; for inspection of the media, for example, to monitor and control print quality; and various other functions. The digital printing system receives the print media from a media source, and after acting on the print media conveys it to a media receiving unit. The print media is maintained under tension as it passes through the digital printing system, but it is not under tension as it is received from the media source.

The printing systems described with reference to FIGS. 1-4 include features and principles of exact constraint for transporting continuously moving web print media past one or more digital printheads, such as inkjet printheads. The apparatus for moving a web of print media, however, works equally well in other types of print media transport systems.

Referring to the schematic side view of FIG. 1, there is shown a digital printing system 10 for continuous web printing according to one embodiment. A first module 20 and a second module 40 are provided for guiding continuous web media that originates from a source roller 12. Following an initial slack loop 52, the media that is fed from source roller 12 is then directed through digital printing system 10, past one or more digital printheads 16 and supporting printing system 10 components. First module 20 has a support structure, shown in more detail subsequently, that includes a cross-track positioning mechanism 22 for positioning the continuously moving web of print media in the cross-track direction, that is, orthogonal to the direction of travel and in the plane of travel. In one embodiment, cross-track positioning mechanism 22 is an edge guide for registering an edge of the moving media. A tensioning mechanism 24, affixed to the support structure of first module 20, includes a structure that sets the tension of the print media.

Downstream from first module 20 along the path of the continuous web media, second module 40 also has a support structure, similar to the support structure for first module 20. Affixed to the support structure of either or both the first or second module 20 or 40 is a kinematic connection mechanism that maintains the kinematic dynamics of the continuous web of print media in traveling from the first module 20 into the second module 40. Also affixed to the support structure of either the first or second module 20 or 40 are one or more angular constraint structures 26 for setting an angular trajectory of the web media.

Still referring to FIG. 1, printing system 10 optionally also includes a turnover mechanism 30 that is configured to turn the media over, flipping it backside-up in order to print on the reverse side. The print media then leaves the digital printing system 10 and travels to a media receiving unit, for example, a take-up roll 18. A take-up roll 18 is then formed, rewound from the printed web media. The digital printing system can include a number of other components, including multiple print heads and dryers, for example, as described in more detail subsequently. Other examples of system components include web cleaners, web tension sensors, and quality control sensors.

A support structure 28 provides a supporting frame for mounting components within module 20. Similarly, a support structure 48 provides a supporting frame for mounting components within module 40. A continuous web of print media 60 moves through printing system 10 beginning at the source roller 12 and ending at the take-up roll 18.

Figure 2:
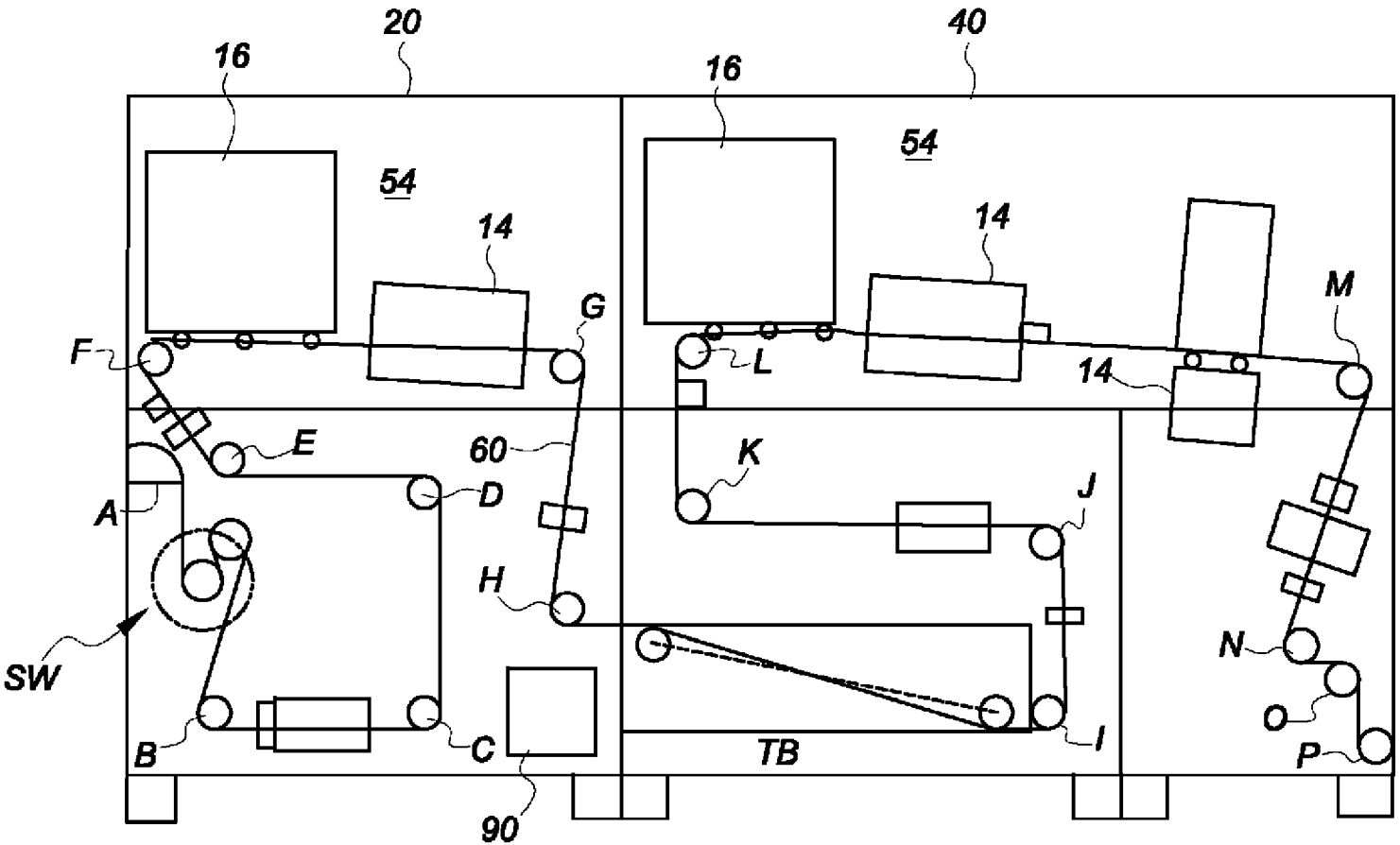
FIG. 2 is an enlarged schematic side view of media transport components of the digital printing system shown in FIG. 1.

The schematic side view diagram of FIG. 2 shows, at enlarged scale from that of FIG. 1, the media routing path through modules 20 and 40 in one embodiment. Within each module 20 and 40, in a print zone 54, each print head 16 is followed by a dryer 14.

Table 1 that follows identifies the lettered components used for web media transport and shown in FIG. 2. An edge guide in which the media is pushed laterally so that an edge of the media contacts a stop is provided at A. The slack web entering the edge guide shifts the print media laterally without interference and without overconstraining the print media. An S-wrap device SW provides stationary curved surfaces over which the continuous web slides during transport. As the paper is pulled over these surfaces the friction of the paper across these surfaces produces tension in the print media. In one embodiment, this device helps to adjust the positional relationship between surfaces, to control the angle of wrap and adjust web tension.

TABLE 1

Roller Listing for FIG. 2

| Media Handling Component | Type of Component |
|---|---|
| A | Lateral constraint (edge guide) |
| SW - S-Wrap | Zero constraint (non-rotating support), Tensioning |
| B | Angular constraint (in-feed drive roller) |
| C | Zero constraint (Castered and Gimbaled Roller) |
| D * | Angular constraint with hinge (Gimbaled Roller) |
| E | Angular constraint with hinge (Gimbaled Roller) |
| F | Angular constraint (Fixed Roller) |
| G | Zero constraint (Castered and Gimbaled Roller) |
| H | Angular constraint with hinge (Gimbaled Roller) |
| TB-TURNOVER | Discussed in more detail below |
| I | Zero constraint (Castered and Gimbaled Roller) |
| J * | Angular constraint with hinge (Gimbaled Roller) |
| K | Angular constraint with hinge (Gimbaled Roller) |
| L | Angular constraint (Fixed Roller) |
| M | Zero constraint (Castered and Gimbaled Roller) |

TABLE 1-continued

| Roller Listing for FIG. 2 | |
|---|---|
| Media Handling Component | Type of Component |
| N | Angular constraint (out-feed drive roller) |
| O | Zero constraint (Castered and Gimbaled Roller) |
| P | Angular constraint with hinge (Gimbaled Roller) |

Note:
Asterisk (*) indicates locations of load cells.

The first angular constraint is provided by in-feed drive roller B. This is a fixed roller that cooperates with a drive roller in the turnover section and with an out-feed drive roller N in second module 40 in order to move the web through the printing system with suitable tension in the movement direction (from left to right as shown in FIG. 2). The tension provided by the preceding S-wrap serves to hold the paper against the in-feed drive roll so that a nip roller is not required at the drive roller. Angular constraints at subsequent locations downstream along the web are often provided by rollers that are gimbaled so as not to impose an angular constraint on the next downstream web span.

There is a single lateral constraint mechanism used at A. Here, at the beginning of the media path, a single edge guide provides lateral constraint that is sufficient for registering the continuous web of print media along the media path. It is significant that only one lateral constraint is actively applied throughout the media path, here, as an edge guide. However, given this lateral constraint and the following angular constraint, the lateral constraint for each subsequent web span is fixed. In one embodiment, a gentle additional force is applied along the cross-track direction as an aid for urging the media edge against the edge guide at A. This force is often referred to as a nesting force as the force helps cause the edge of the media to nest alongside the edge guide.

Angular constraints, rollers B, D, E, F, H, J, K, L, N, P, are Included in printing system 10. Each angular constraint sets the angular trajectory of the web as it moves along. However, the web is not otherwise steered in the embodiment shown.

Fixed rollers at F and L precede the printheads for each module, providing the desired angular constraint to the web in the print zone. These rollers provide a suitable location of mounting an encoder for monitoring the motion of the media through the printing system. Under the printheads, the print media is supported by fixed non-rotating supports. These supports provide zero constraint to the web.

Roller G is a castered and gimbaled roller providing zero constraint. Castered and gimbaled rollers provide zero constraint along the web path. These mechanisms are used, for example, near the input to each module, making each module independent of angular constraints from earlier mechanisms. Other types of mechanisms that provide zero constraint include stationary curved surfaces or castered rollers.

If the span between roller F and G is sufficiently long, the continuous web can lack sufficient stiffness to cause castered roller G to align properly with the web. In such cases, roller G need not be castered. Because of the relative length to width ratio of the media in the segment between F and G, the continuous web in that segment is considered to be non-stiff, showing some degree of compliance in the cross-track direction. As a result, an additional constraint is included to exactly constrain that web segment. This is accomplished by eliminating the caster from roller G. Axially compliant rollers can alternately be used where cross-track constraint is undesirable.

Figure 3:
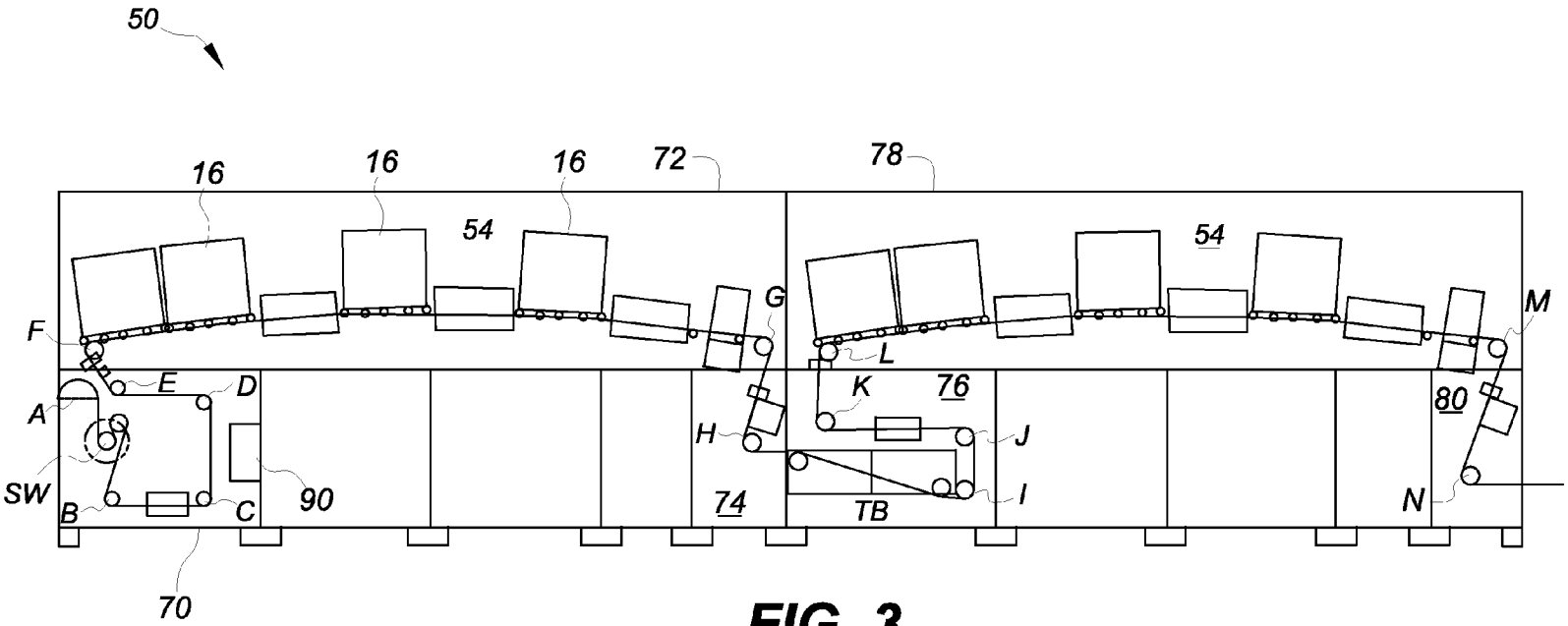
FIG. 3 is a schematic side view of a large-scale two-sided digital printing system according to another example embodiment of the present invention.

A digital printing system 50 shown schematically in FIG. 3 has a considerably longer print path than that shown in FIG. 3, but provides the same overall sequence of angular constraints, with the same overall series of gimbaled, castered, and fixed rollers. Table 2 lists the roller arrangement used with the system of FIG. 3 in one embodiment. Brush bars, shown between rollers F and G and between L and M in FIG. 3, are non-rotating surfaces and thus apply no lateral or angular constraint forces.

TABLE 2

| Roller Listing for FIG. 3 | |
|---|---|
| Media Handling Component | Type of Component |
| A | Lateral constraint (edge guide) |
| SW - S-Wrap | Zero constraint (non-rotating support) |
| B | Angular constraint (in-feed drive roller) |
| C | Zero constraint (Castered and Gimbaled Roller) |
| D * | Angular constraint with hinge (Gimbaled Roller) |
| E | Angular constraint with hinge (Gimbaled Roller) |
| F | Angular constraint (Fixed Roller) |
| G | Angular constraint with hinge (Gimbaled Roller) |
| H | Angular constraint with hinge (Gimbaled Roller) |
| TB-TURNOVER | Discussed in more detail below |
| I | Zero constraint (Castered and Gimbaled Roller) |
| J * | Angular constraint with hinge (Gimbaled Roller) |
| K | Angular constraint with hinge (Gimbaled Roller) |
| L | Angular constraint (Fixed Roller) |
| M | Angular constraint with hinge (Gimbaled Roller) |
| N | Angular constraint (out-feed drive roller) |
| O | Zero constraint (Castered and Gimbaled Roller) |
| P | Angular constraint with hinge (Gimbaled Roller) |

Note:
Asterisk (*) indicates locations of load cells.

Turnover mechanism (TB) 30 is shown as part of second module 40. Turnover mechanism TB can optionally be configured as a separate module, with its web media handling compatible with that of second module 40. The position of turnover mechanism TB is appropriately between print zones 54 for opposite sides of the media.

Load cells are provided in order to sense web tension at one or more points in the system. In the embodiments of FIGS. 2 (Table 1) and 3 (Table 2), load cells are provided at gimbaled rollers D and J. Control logic for the respective digital printing system 50 monitors load cell signals at each location and, in response, makes any needed adjustment in motor torque in order to maintain the proper level of tension throughout the system. For the embodiments of FIGS. 2 and 3, the pacing drive component of the printing apparatus is the turnover module TB. There are two tension-setting mechanisms, one preceding and one following turnover module TB. On the input side, load cell signals at roller D indicate tension of the web preceding turnover module TB; similarly, load cell signals at roller J indicate web tension on the output side, between turnover module TB and take-up roll 18. Control logic for the appropriate in- and out-feed driver rollers at B and N, respectively, can be provided by an external computer or processor, not shown in the figures of this application. Optionally, an on-board control logic processor 90, such as a dedicated microprocessor or other logic circuit, is provided for maintaining control of web tension within each tension-setting mechanism and for controlling other machine operation and operator interface functions.

The tension in a module preceding the turn bar and a module following the turnover module TB can be independently controlled relative to each other further enhancing the flexibility of the printing system. To accomplish this, a drive motor is included in the turnover module TB. Alternatively, a drive motor is appropriately located along the web path so that tension within one module is independently controlled relative to tension in another module.

The configurations of FIGS. 1 and 2 were described as including two modules 20 and 40. In the FIG. 1 configuration, each module provided a complete printing apparatus. However, the "modular" concept need not be restricted to apply to complete printers. For example, the configuration of FIG. 3 is considered as formed of as many as seven modules.

An entrance module 70 is the first module in sequence, following the media supply roll, as was shown earlier with reference to FIG. 1. Entrance module 70 provides the edge guide A that positions the media in the cross-track direction and provides the S-wrap SW or other appropriate web tensioning mechanism. In the embodiment of FIG. 3, entrance module 70 provides the in-feed drive roller B that cooperates with SW and other downstream drive rollers to maintain suitable tension along the web, as noted earlier. Rollers C, D, and E are also part of entrance module 70 in the FIG. 3 embodiment.

A first printhead module 72 accepts the web media from entrance module 70, with the given edge constraint, and applies an angular constraint with fixed roller F. A series of stationary brush bars or, optionally, minimum-wrap rollers then transport the web along past a first series of printheads 16 with their supporting dryers and other components. Here, because of the considerable web length in the web segment beyond the angular constraint provided by roller F (that is, the distance between rollers F and G), that segment can exhibit flexibility in the cross track direction which is an additional degree of freedom that needs to be constrained. Eliminating the expected caster of roller G provides the additional constraint needed in that span.

An end feed module 74 provides an angular constraint to the incoming media from printhead module 72 by gimbaled roller H. Turnover module TB accepts the incoming media from end feed module 74 and provides an angular constraint with its drive roller, as described previously.

A forward feed module 76 provides a web span corresponding to each of its gimbaled rollers J and K. These rollers again provide angular constraint only; the lateral constraint for web spans in module 76 is obtained from the edge of the incoming media itself.

A second printhead module 78 accepts the web media from forward feed module 76, with the given edge constraint, and applies an angular constraint with fixed roller L. A series of stationary brush bars or, optionally, minimum-wrap rollers then feed the web along past a second series of printheads 16 with their supporting dryers and other components. Here again, because of considerable web length in the web segment (that is, extending the distance between rollers L and M), that segment will exhibit flexibility in the cross track direction which is an additional degree of freedom that needs to be constrained, eliminating the expected caster of roller M provides the additional constraint needed in that span. When overhang is present in the web span (that is, extending the distance between rollers L and M), exact constraint principles are sometimes difficult to apply successfully. Gimbaled roller M provides additional constraint over this long web span.

An out feed module 80 provides an out-feed drive roller N that serves as angular constraint for the incoming web and cooperates with other drive rollers and sensors along the web media path that maintain the desired web peed and tension. Optional rollers O and P (not shown in FIG. 3) are also provided for directing the printed web media to an external accumulator or take-up roll.

Each module in this sequence provides a support structure and an input and an output interface for kinematic connection with upstream or downstream modules. With the exception of the first module in sequence, which provides the edge guide at A, each module uses one edge of the incoming web media as its "given" lateral constraint. The module then provides the needed angular constraint for the incoming media in order to provide the needed exact constraint or kinematic connection of the web media transport. It can be seen from this example that a number of modules can be linked together. For example, an additional module can alternately be added between any other of these modules in order to provide a useful function for the printing process.

Module function is adaptable to the configuration of the complete printing system. In many cases, rollers and components are interchangeable, including rollers at the interface between modules, moved from one module to another depending on the printer configuration. Frames and other support structures for the different modules either use a standard design and dimensions or are designed differently according to the contemplated application. This also helps to simplify upgrade situations.

There are a number of ways to track web position in order to locate and position inkjet dots or other marking that is made on the media. A variety of encoding and sensing devices are used for this purpose along with the associated timing and synchronization logic, provided by control logic processor 90 or by some other dedicated internal or external processor or computer workstation. Such encoders or sensing devices are typically placed just upstream of the print zone containing the one or more printheads, and are preferably placed on a fixed roller so as to avoid interfering with self aligning characteristic of castered or gimbaled rollers.

Sometimes an active steering mechanism is used within a web span, for example, when the web span length of an overhang exceeds its width, so that the web no longer has sufficient mechanical stiffness for exact constraint techniques. This happens, for example, where there is considerable overhang along the web span, that is, length of the web extending beyond the angular constraint for the span. This is the case for modules 72 and 78 in the embodiment described with respect to FIG. 3. In such a case, a castered roller in the overhang section of the web often no longer behave as a zero constraint, since some amount of lateral force from the web is needed in order to align the castered roller mechanism to the angle of the web span. This under-constraint condition, due to length of the overhang along this lengthy web span, is corrected by application of an additional constraint.

Kinematic connection between modules 20 and 40 follows the same basic principles that are used for exact constraint within each web span. That is, cross-track or edge alignment is taken from the preceding module. Any attempt to re-register the media edge as it enters the next module would cause an overconstraint condition. Rather than attempting to steer the continuously moving media through a rigid and possibly over-constrained transport system, the media transport components self-align to the media, thereby providing acceptable registration at high transport speeds and reducing the likelihood of damage to the media or misregistration of applied ink or other colorant to the media.

Where multiple modules are used, as was described with reference to the embodiment shown in FIG. 3, the system should include a master drive roller that is in control of web transport speed. Often multiple drive rollers are used and help provide proper tension in the web transport (x) direction, such as by applying suitable levels of torque, for example. In one embodiment, the turnover TB module drive roller acts as the master drive roller. The in-feed drive roller at B in module 20 adjusts its torque according to a load sensing mechanism or load cell that senses web tension between the drive and in-feed rollers. Similarly, out-feed drive roller N is controlled in order to maintain a desired web tension within second module 40.

Figure 4:
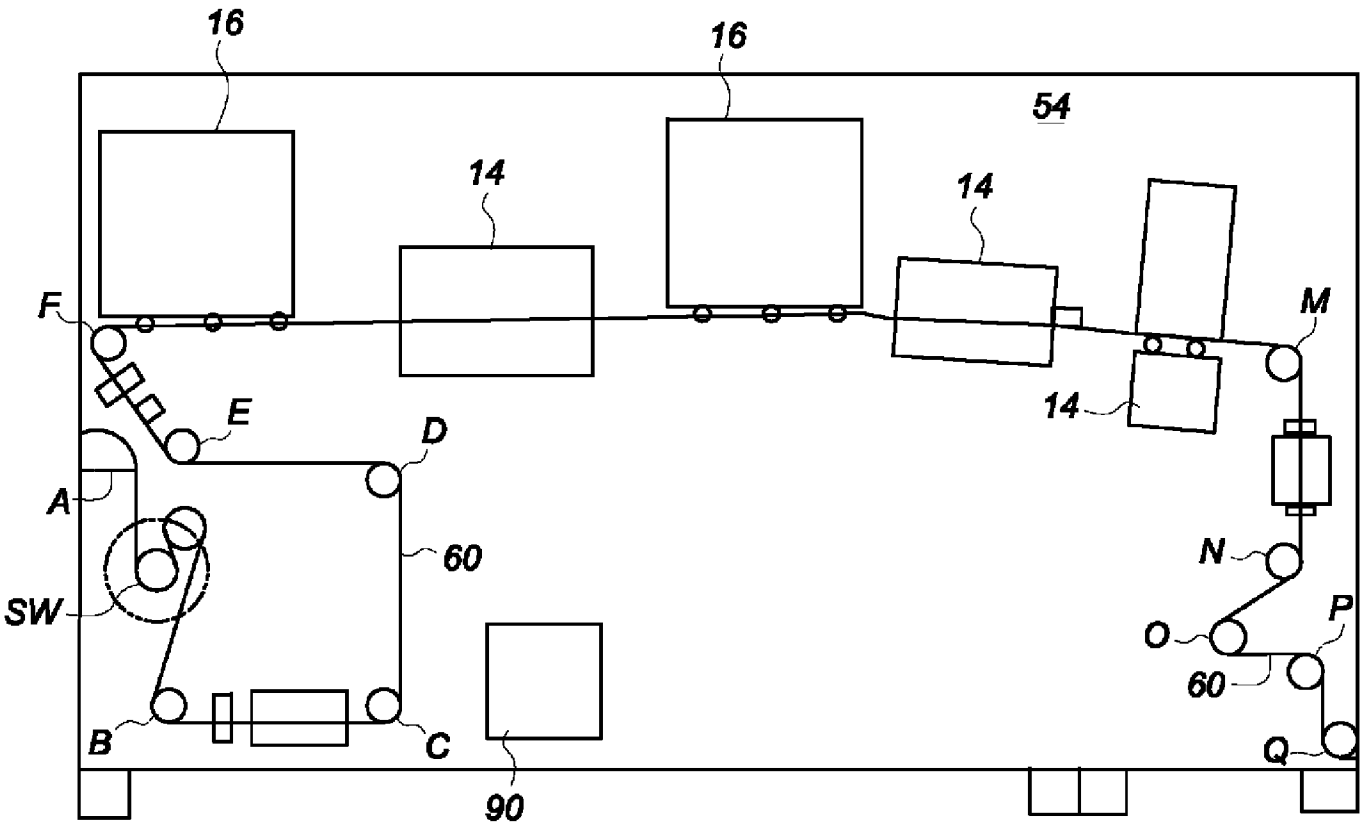
FIG. 4 is a schematic side view of a digital printing system according to another example embodiment of the present invention.

Referring to FIG. 4, the web position in the span containing the printheads 16 and dryers 14 is defined by a lateral constraint in the form of an edge guide F located immediately before the print zone and an angular constraint, non-pivoting roller M, located immediately after the print zone. With the media under tension as it wraps around the shoe of the edge guide F, the shoe is free to pivot. This ensures that the media has uniform tension across its width in the print zone. In this embodiment, the shoe rotates about an axis at the center of the shoe and perpendicular to the plane of the web segment from F to M. This rotation orientation reduces variation in spacing between the media and printheads 16 as shoe F pivots. When the media is not under tension as it passes over the edge guide, the edge guide shoe need not be free to pivot.

This embodiment also has an edge guide A and a non-pivoting drive roller B that establish an initial path for the media in the first span of the media entering the printing system. The combination of the castered and gimbaled rollers C and E and the gimbaled roller D removes an overconstraint condition that would have existed between the first media span and the span across the print zone. Edge guide A helps to ensure that the only minor shifting of the lateral position of the web is needed at edge guide F. This allows the bias force needed to shift the media to the edge stop to be kept to a minimum. With the media under tension as it passes edge guide F, the required bias force to shift the media is greater than it would be if the media were not under tension. The constraints provided by each roller are listed in table 3.

TABLE 3

Roller Listing for FIG. 4

| Media Handling Component | Type of Component |
|---|---|
| A | Lateral Constraint (Edge Guide) |
| SW - S-Wrap | Zero Constraint (Non-Rotating Support), Tensioning |
| B | Angular Constraint (In-Feed Drive Roller) |
| C | Zero Constraint (Castered and Gimbaled Roller) |
| D * | Angular Constraint with Hinge (Gimbaled Roller) |
| E | Zero Constraint (Castered and Gimbaled Roller) |
| F | Lateral Constraint (Edge Guide) |
| Brush Bars | Zero Constraint (Non-Rotating Support) |
| M | Angular Constraint (Non-Pivoting Roller) |
| N | Zero Constraint (Castered and Gimbaled Roller) |
| O | Angular Constraint (Out-Feed Drive Roller) |
| P | Zero Constraint (Castered and Gimbaled Roller) |
| Q | Angular Constraint with Hinge (Gimbaled Roller) |

Note:
Asterisk (*) Indicates Locations Of Load Cells.

In the embodiment of FIG. 4, the printing system doesn't comprise multiple modules. The media transport components are secured to a single support structure. Through the use of rollers that align to the web, it is not necessary to precisely align the rollers to each other in this system. This greatly reduces the assembly costs for the system. As precise alignments are not required, the support structure to which the various rollers and web guides are mounted doesn't need to be as stiff as prior art frames. This allows the mass of the support structure to be greatly reduced which reduces shipping and setup costs.

As described above, continuous web media transport within and between one, two, three, or more modules is accomplished by applying exact constraint techniques. This flexibility allows a web transport arrangement that provides acceptable registration and repeatable performance at high speeds commensurate with the requirements of high-speed color inkjet printing. As has been shown, multiple modules can be integrated to form a printing system, without the requirement for painstaking alignment of rollers or other media handling components at the interface between two modules.

It has been found that web transports systems as described above maintain effective control of the print media in the context of a digital print system where the selected portions of the print media are moistened in the printing process. This is true even when the print media is prone to expanding in length and width and to becoming less stiff when it is moistened, such as for cellulose based print media moistened by a water based ink. This enables the individual color planes of a multi-colored document to be printed with acceptable registration to each other.

The digital printing systems having one or more printheads that selectively moisten at least a portion of the print media as described above include a media transport system that serves as a support structure to guide the continuous web of print media. The support structure includes an edge guide or other mechanism that positions the print media in the cross track direction. This first mechanism is located upstream of the printheads of the digital printing system. The print media is pulled through the digital printing system by a driven roller that is located downstream of the printheads. The systems also include a mechanism located upstream of printheads of the printing system for establishing and setting the tension of the print media. Typically it is also located downstream of the first mechanism used for positioning the print media in the cross track direction. The transport system also includes a third mechanism to set an angular trajectory of the print media. This can be a fixed roller (for example, a non-pivoting roller) or a second edge guide. The printing system also includes a roller affixed to the support structure configured to align to the print media being guided through the printing system without necessarily being aligned to another roller located upstream or downstream relative to the roller. The castered, gimbaled or castered and gimbaled rollers serve in this manner.

As noted earlier, slack loops are not required between or within modules. Slack loops can be appropriate where the continuous web is initially fed from a supply roll or as it is re-wound onto a take-up roll, as was described with reference to the printing apparatus of FIG. 1.

This system is adaptable for a printing system of variable size and facilitates straightforward reconfiguration of a system without requiring precise adjustment and alignment of rollers and related hardware when modules are combined. By using exact constraint mechanisms, rollers can be mounted within the equipment frame or structure using a reasonable amount of care in mechanical placement and seating within the frame, but without the need to individually align and adjust each roller along the path, as would be necessary when using conventional paper guidance mechanisms. That is, roller alignment with respect to either the media path or another roller located upstream or downstream is not needed.

Referring to FIGS. 5-8, example embodiments of an apparatus for moving the continuous web of print media 60 are shown. A roller 100, having an axis of rotation 102, includes a pattern of recesses 104 and ridges 106 positioned along the axis of rotation 102. Roller 100 is divided into sections including a first section 108, a second section 110, and a third section 112. The second section 110 is located between the first section 108 and the third section 112 when viewed along the axis of rotation 102. Roller 100 includes a profile as viewed along the axis of rotation 102 that is typically referred to as a concave profile. In this profile, the diameter 114 of the ridges 106 located in the first section 108 of the roller 100 and the diameter 116 of ridges 106 located in the third section 112 of the roller 100 are greater than the diameter 118 of the ridges 106 located in the second section 110 of the roller 100.

Figure 5:
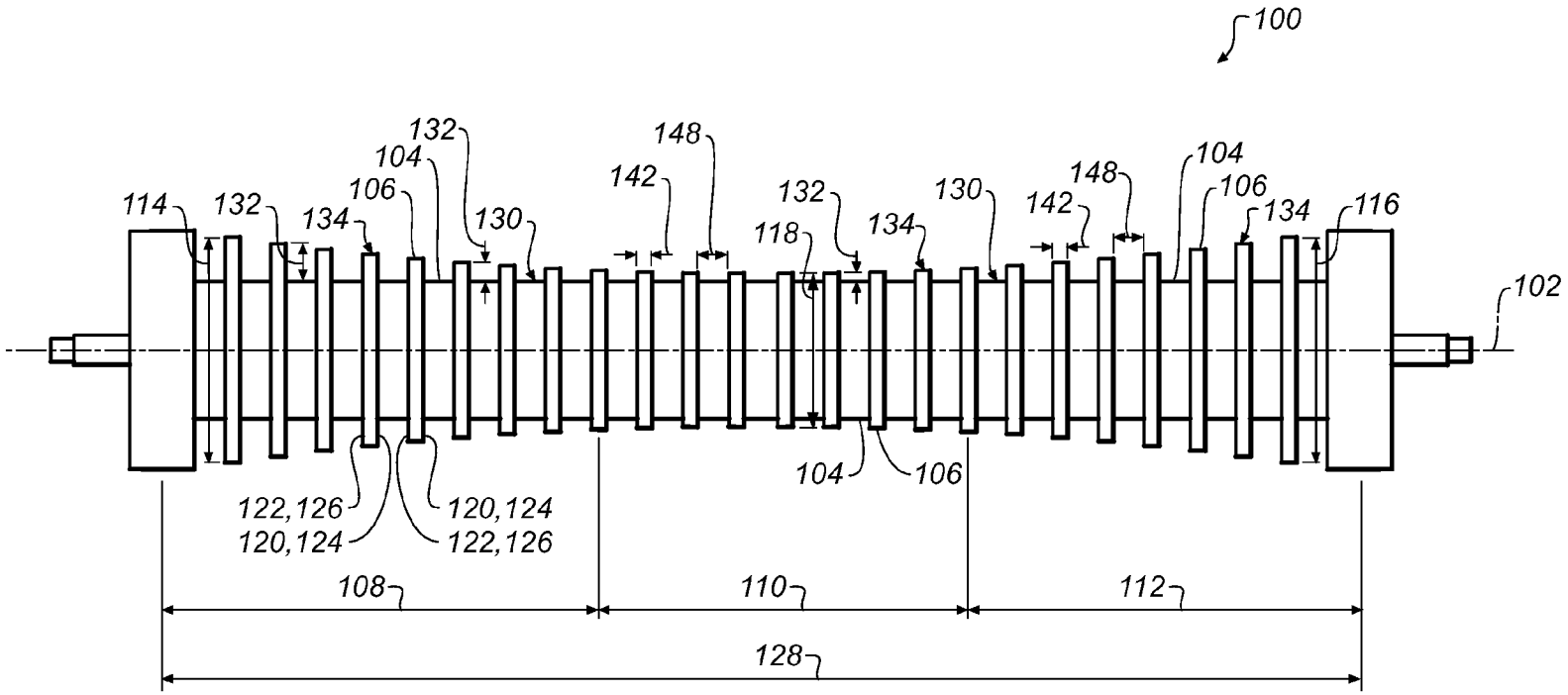
FIG. 5 is a schematic side view of an example embodiment of the present invention.

The concave profile of roller 100, created by ridges 106, causes the print media 60 to contact different locations of roller 100 as the web of print media 60 wraps around a portion of roller 100. This allows causes roller 100 to provide lateral forces on the web of print media 60 that spread (or stretch) the print media 60 in the cross track direction of the printing system 10 (to left and to the right as shown in FIG. 5). This helps to compensate for cross track expansion of the print media 60 caused by the absorption of water-based ink that is applied to the print media 60 in print zone 54. The surface finish and coefficient of friction of the ridges 106 of roller 100 can be selected to provide appropriate friction between print media 60 and roller 100 for the level of in-track tension, tension in the direction of print media travel, and amount of wrap, referred to as wrap angle, of print media 60 around roller 100.

In contrast to a pattern of ridges and recesses that spiral around and along a roller in a non-perpendicular fashion relative to the axis of rotation of the roller, the edges 120, 122 of ridges 106 and the edges 124, 126 of recesses 104 wrap directly around roller 100 in a perpendicular fashion relative to the axis of rotation 102 of roller 100. This creates ridges 106 and recesses 104 of roller 100 that also extend (or wrap around) the circumference of roller 100 in a perpendicular fashion relative to the axis of rotation 102 roller 100. Ridges 106 and recesses 104 extend in periodic manner along the length 128 of roller 100. Recesses 104 provide area for the expanded print media 60 to fit into as the print media 60 wraps around roller 100. This reduces the likelihood of the print media 60 wrinkling as the print media 60 wraps around roller 100 and moves through printing system 10. Preferably, the combination of in-track web tension and the wrap angle is sufficient to cause print media 60 to pull slightly into the recesses 104 of roller 100. In some applications, the depth of recesses 104 is sized so that the portions of the print media 60 pulled into the recesses 104 of roller 100 contact a lower surface 130 of roller 100 which helps minimize print media 60 distortion as the print media is pulled into the recesses 104.

In FIG. 5, the pattern of recesses 104 and ridges 106 positioned along the axis of rotation 102 of roller 100 is an alternating pattern of recesses 104 and ridges 106. The ridges 106 have a uniform width 142 as viewed along the axis of rotation 102 of roller 100. The diameter of each ridge 106 increases in a stepwise manner as viewed from the second section 110 of roller 100 toward both the first section 108 of roller 100 and the third section 112 of roller 100. Each recess 104 includes a surface 130 that is parallel to the axis of rotation 102 of roller 100. The depth 132 of each recess varies when viewed from the second section 110 of roller 100 toward both the first section 108 of roller 100 and the third section 112 of roller 100. The surfaces 134 of ridges 106 are parallel to the axis of rotation 102 of roller 100

Figure 6:
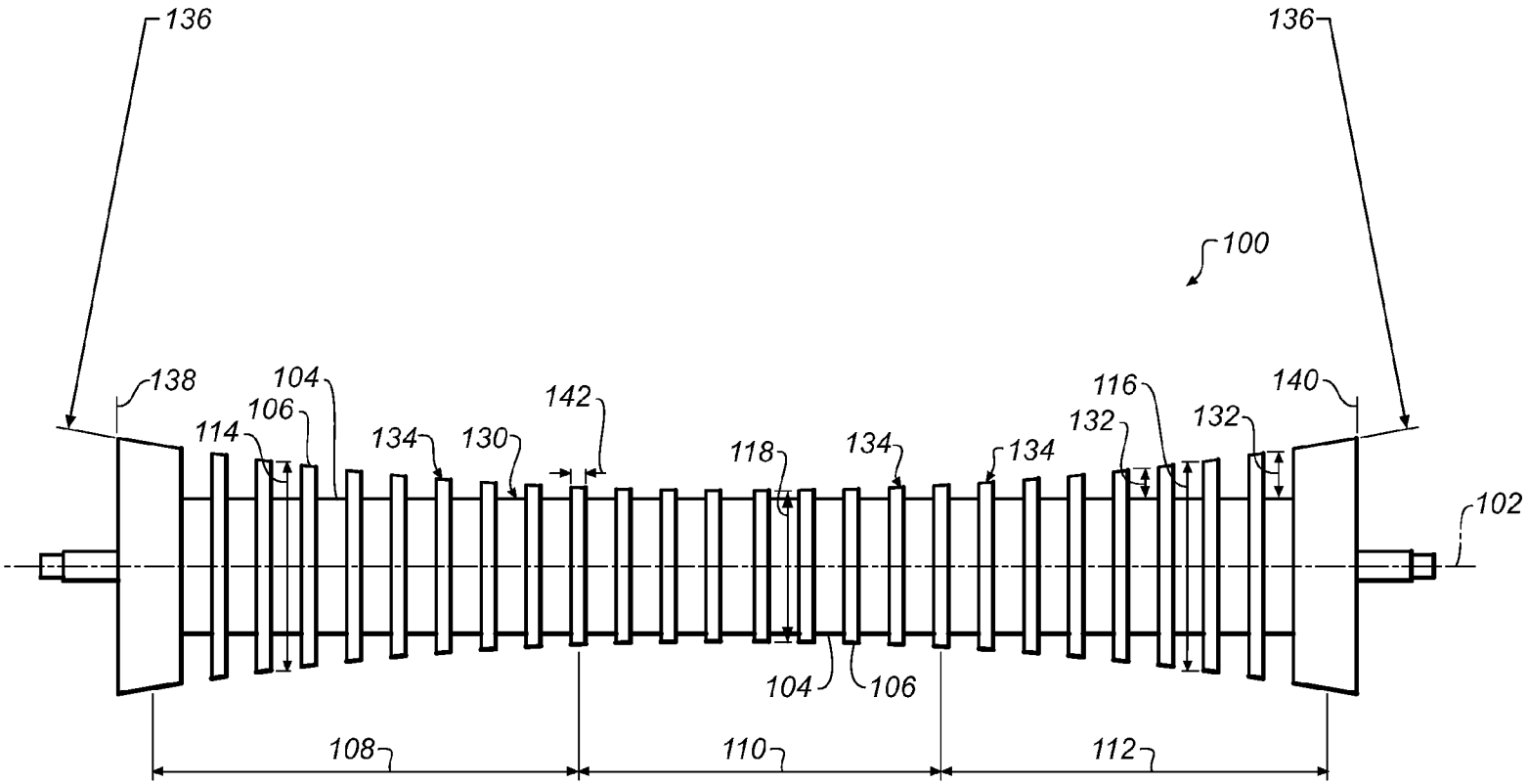
FIG. 6 is a schematic side view of another example embodiment of the present invention.

In FIG. 6, the pattern of recesses 104 and ridges 106 positioned along the axis of rotation 102 of roller 100 is an alternating pattern of recesses 104 and ridges 106. The ridges 106 have a uniform width 142 as viewed along the axis of rotation 102 of roller 100. The diameter of each ridge 106 increases when viewed from the second section 110 of roller 100 toward both the first section 108 of roller 100 and the third section 112 of roller 100. Each recess 104 includes a lower surface 130 that is parallel to the axis of rotation 102 of roller 100. The depth 132 of each recess varies when viewed from the second section 110 of roller 100 toward both the first section 108 of roller 100 and the third section 112 of roller 100. The surfaces 134 of ridges 106 are angled relative to the axis of rotation 102 of roller 100 and are configured to create a radius of curvature 136 as viewed from a plane perpendicular to the axis of rotation of the roller. The radius of curvature 136 begins at the outside edge 138 of the first section 108 of roller 100, extends through the section 110 of roller 100, and ends at the outside edge 140 of the third section 112 of roller 100.

Figure 7:
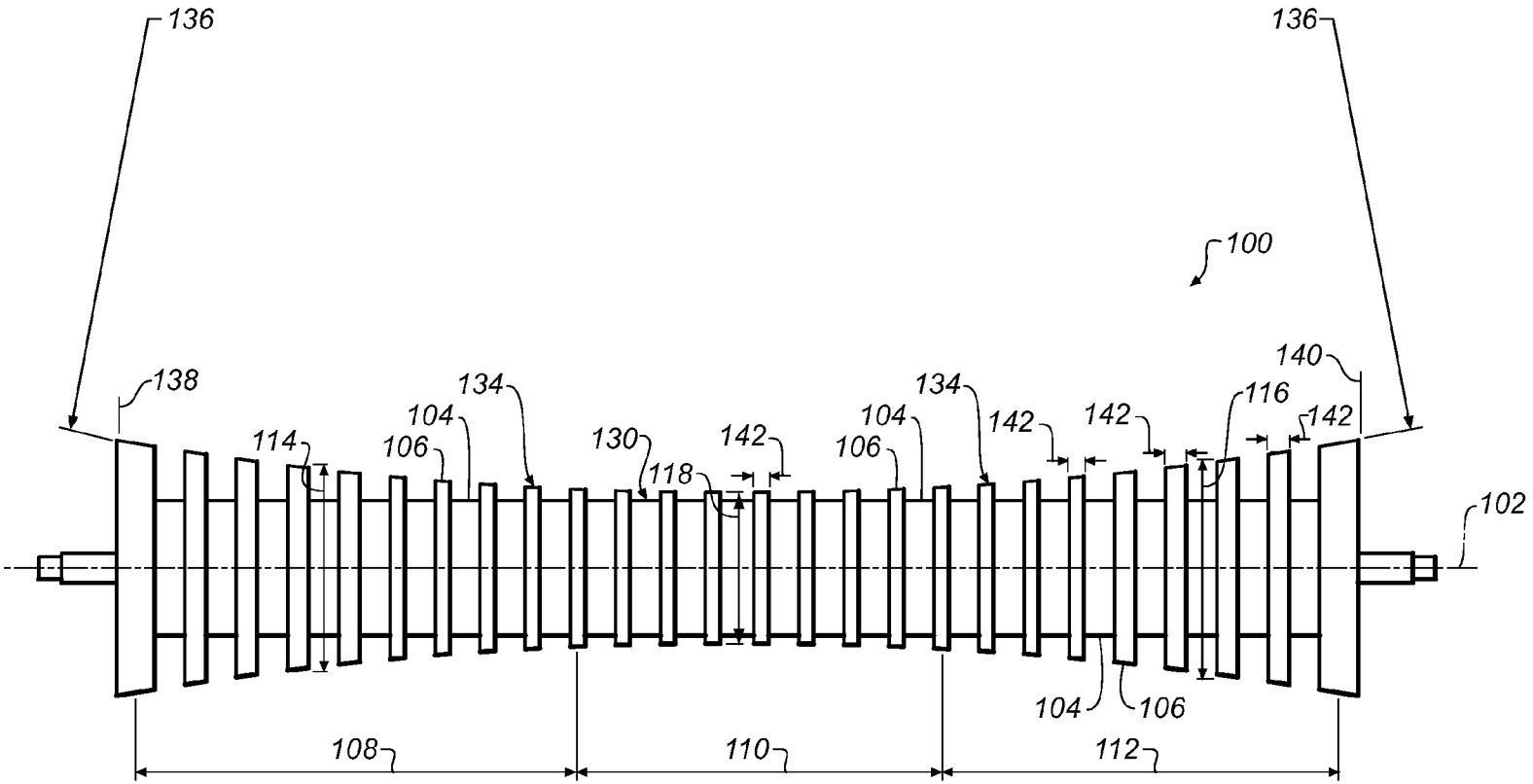
FIG. 7 is a schematic side view of another example embodiment of the present invention.

In FIG. 7, the pattern of recesses 104 and ridges 106 positioned along the axis of rotation 102 of roller 100 is an alternating pattern of recesses 104 and ridges 106. The diameter of each ridge 106 increases when viewed from the second section 110 of roller 100 toward both the first section 108 of roller 100 and the third section 112 of roller 100. Additionally, the width 142 of at least a portion of ridges 106 located in the first section 108 of roller 100 and the third section 112 of roller 100 is greater than the width of ridges located in the second section 110 of roller 100. The increased width of the ribs toward each end of the roller enhance the lateral forces to spread the print media, when compared to rollers having uniform rib width along the length of the roller. Each recess 104 includes a lower surface 130 that is parallel to the axis of rotation 102 of roller 100. The depth 132 of each recess varies when viewed from the second section 110 of roller 100 toward both the first section 108 of roller 100 and the third section 112 of roller 100. The surfaces 134 of ridges 106 are angled relative to the axis of rotation 102 of roller 100 and are configured to create a radius of curvature 136 as viewed from a plane perpendicular to the axis of rotation of the roller. The radius of curvature 136 begins at the outside edge 138 of the first section 108 of roller 100, extends through the section 110 of roller 100, and ends at the outside edge 140 of the third section 112 of roller 100.

Figure 8:
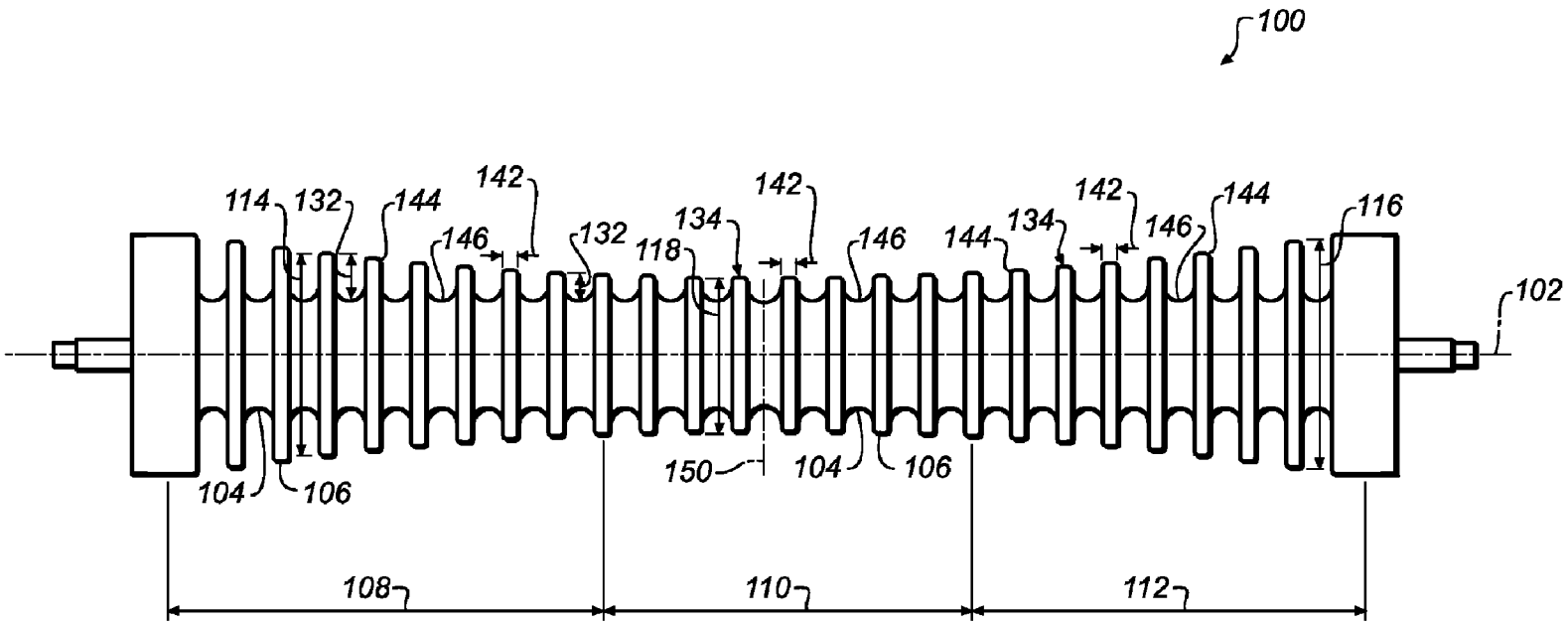
FIG. 8 is a schematic side view of another example embodiment of the present invention.

In FIG. 8, the pattern of recesses 104 and ridges 106 positioned along the axis of rotation 102 of roller 100 is an alternating pattern of recesses 104 and ridges 106. The ridges 106 have a uniform width 142 as viewed along the axis of rotation 102 of roller 100. The diameter of each ridge 106 increases in a stepwise manner as viewed from the second section 110 of roller 100 toward both the first section 108 of roller 100 and the third section 112 of roller 100. Each ridge 106 includes rounded corners 144. These rounded corners reduce the stresses on print media moving over the roller near the edges of the ridges. Each recess 104 includes a surface 130 that includes a radius of curvature 146 relative to the axis of rotation 102 of roller 100. The depth 132 of each recess varies when viewed from the second section 110 of roller 100 toward both the first section 108 of roller 100 and the third section 112 of roller 100. The surfaces 134 of ridges 106 are parallel to the axis of rotation 102 of roller 100. The pattern of ridges and recesses is symmetric about the center (represented by centerline 150) of the roller, so that left side of the roller is a mirror image of the right side of the roller as viewed in FIG. 8.

Although certain aspects of the example embodiments of the web moving apparatus have been discussed with reference to individual figures of FIGS. 5-8. It should be understood that these aspects are interchangeable or combinable. For example, the width 142 of ridges 106 located in the first section 108 of roller 100 and the third section 112 of roller 100 can be greater than the width ridges located in the second section if the roller in the example embodiment described with reference to FIG. 5. The embodiments described with reference to FIGS. 5-7 can have recess 104 that include a surface 130 that includes a radius of curvature 146 relative to the axis of rotation 102 of roller 100. The ridges 106 described in these embodiments can include rounded corners 144.

Figure 9:
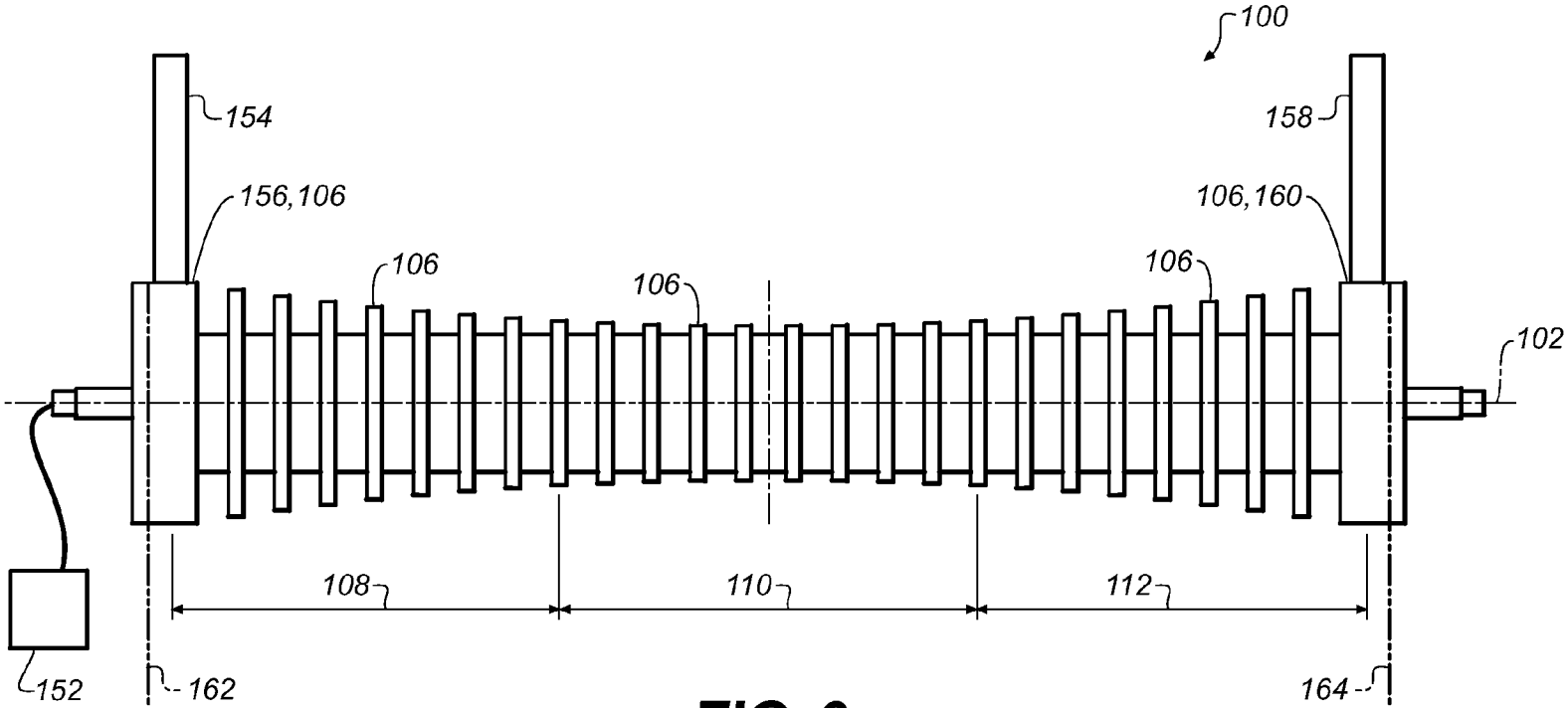
FIG. 9 is a schematic side view of another example embodiment of the present invention.

As shown in FIGS. 5-8, roller 100 is free to rotate about its axis of rotation 102. Referring to FIG. 9, in other example embodiment, roller 100 is a driven roller, for example, driven directly by a motor 152 or by using another conventional roller driving mechanism. A first nip roller 154 is positioned to engage a first ridge 156 of the ridges 106 of roller 100 and a second nip roller 158 is positioned to engage a second ridge 160 of the ridges of the roller. Typically, the first ridge 156 is located in the first section 108 of roller 100 and the second ridge 160 is located in the third section 112 of roller 100 to help facilitate print media movement and minimize potential wrinkling of the print media. As shown in FIG. 9, first ridge 156 is a ridge located proximate to a first edge 162 of print media and second ridge 160 is a ridge located proximate to a second edge 164 of print media, as viewed in a cross track direction. As described above, certain aspects of the example embodiments of the web moving apparatus have been discussed with reference to individual figures of FIGS. 5-9. It should be understood that these aspects are interchangeable or combinable.

As shown in FIGS. 5-9, the width 148 of each recess 104 of roller 100 is uniform. In other example embodiments, the recess 104 width 148 can vary. Alternatively, the width 142 of ridges 106 as viewed along the axis of rotation can vary. For example, the width of the ridges located proximate to a first edge and a second edge of print media, as viewed in a cross track direction, is different when compared to the width of ridges located in other areas of the print media. This is done so that the edges 162, 164 of the print media 60 are in contact with a ridge 106 of roller 100. In applications that contemplate moving print media 60 of various widths, wider ridges 156, 160 are located proximate to the anticipated edge 162, 164 locations for each of the anticipated print media 60 widths.

Referring back to FIGS. 1-8, after roller 100 has been provided, the web of print media 60 is caused to contact and wrap around a portion of roller 100 as the web of print media 60 moves past roller 100. Typically, this is accomplished by appropriately positioning roller 100 and print media web 60 relative to each other, for example, by locating roller 100 in one or both of roller locations G or M as described above. When provided roller 100 freely rotates about its axis of rotation, movement of the web of print media is accomplished using a print media driving mechanism, for example, one of the driven rollers described above with reference to FIGS. 1-4.

When roller 100 is a driven roller, the web of print media 60 is also caused to contact and wrap around a portion of roller 100 as the web of print media 60 moves past roller 100. After first nip roller 154 is positioned to engage first ridge 156 of ridges 106 of roller 100 and second nip roller 158 is positioned to engage second ridge 160 of ridges 106 of roller 100, the web of print media 60 is caused to pass between first nip roller 154 and first ridge 156 and to pass between second nip roller 158 and second ridge 160. Typically, this is accomplished by appropriately positioning roller 100, first nip roller 154, second nip roller 158, and print media web 60 relative to each other, for example, by locating roller 100, first nip roller 154, and second nip roller 158, in one or both of roller locations G or M as described above. Movement of the web of print media 60 is accomplished by driving roller 100 using, for example, a motor or another conventional roller driving mechanism.

One or more of printheads 16 ejects ink selectively moisten at least a portion of the web of print media 60 as the web of print media 60 is guided through printing system 10. Roller 100 is positioned downstream from the printhead 16. An optionally included dryer 14, positioned downstream from the printhead and upstream from the roller, removes moisture from the print media 60 as the print media 60 moves past dryer 14.

The invention has been described in detail with particular reference to certain preferred embodiments thereof, but it will be understood that variations and modifications can be effected within the spirit and scope of the invention.

PARTS LIST

10. Printing system
12. Source roller
14. Dryer
16. Digital printhead
18. Take-up roll
20. Module
22. Cross-track positioning mechanism
24. Tensioning mechanism
26. Constraint structure
28. Support structure
30. Turnover mechanism
40. Module
48. Support structure
50. Digital printing system
52. Slack loop
54. Print zone
60. Web of print media
70. Entrance module
72. Printhead module
74. End feed module
76. Forward feed module
78. Printhead module
80. Out-feed module
90. Control logic processor
100. Roller
102. Axis of rotation
104. Recesses
106. Ridges
108. First section
110. Second section
112. Third section
120. Edges
122. Edges
124. Edges
126. Edges
128. Length
130. Surface
132. Depth
134. Surfaces
136. Curvature
138. Outside edge
140. Outside edge
142. Uniform width
144. Rounded corners
146. Curvature
148. Width
150. Centerline
152. Motor
154. First nip roller

156. First ridge
158. Second nip roller
160. Second ridge
162. First edge
164. Second edge
A, B, C, D, E, F, G, H, I, J, K, L, M, N, O, P. Rollers
SW. S-wrap
TB. Turnover module

The invention claimed is:

1. A method of printing comprising:

providing a printhead;

providing a roller positioned downstream from the printhead;

selectively moistening at least a portion of the web of print media as the web of print media is guided through the printing system using the printhead; and causing the print media to contact and wrap around a portion of the roller as the print media moves past the roller, the roller having an axis of rotation, the roller including a pattern of recesses and ridges positioned along the axis of rotation of the roller, the roller including a first section, a second section, and a third section, the second section being located between the first section and the third section as viewed along the axis of rotation, the roller including a profile as viewed along the axis of rotation in which the diameter of the ridges located in the first section of the roller and the diameter of ridges located in the third section of the roller are greater than the diameter of the ridges located in the second section of the roller.

2. The method of claim 1, further comprising:

providing a dryer positioned downstream from the printhead and upstream from the roller; and removing moisture from the print media using the dryer as the print media moves past the dryer.

3. The method of claim 1, wherein causing the web of print media to contact and wrap around a portion of the roller as the web of print media moves past the roller further comprises:

providing the roller that freely rotates about its axis of rotation; and moving the web of print media past the roller using a print media driving mechanism.

4. A method of printing comprising:

providing a printhead;

providing a roller positioned downstream from the printhead;

selectively moistening at least a portion of the web of print media as the web of print media is guided through the printing system using the printhead; and causing the print media to contact and wrap around a portion of the roller as the print media moves past the roller, the roller having an axis of rotation, the roller including a pattern of recesses and ridges positioned along the axis of rotation of the roller, the roller including a first section, a second section, and a third section, the second section being located between the first section and the third section as viewed along the axis of rotation, the roller including a profile as viewed along the axis of rotation in which the diameter of the ridges located in the first section of the roller and the diameter of ridges located in the third section of the roller are greater than the diameter of the ridges located in the second section of the roller, wherein causing the web of print media to contact and wrap around a portion of the roller as the web of print media moves past the roller further comprises:

providing a first nip roller positioned to engage a first ridge of the ridges of the roller and a second nip roller positioned to engage a second ridge of the ridges of the roller;

causing the web of print media to pass between the first nip roller and the first ridge and to pass between the second nip roller and the second ridge; and driving the roller.

* * * * *